US005479965A

United States Patent [19]

Rydborn

[11] Patent Number: 5,479,965

[45] Date of Patent: Jan. 2, 1996

[54] REED ASSOCIATED LIGHT SENSITIVE APPARATUS FOR MONITORING WEFT THREAD IN A LOOM

[76] Inventor: Sten Åke O. Rydborn, Klöxhultsvägen 21, 343 00 ÄAlmhult (SE), Sweden

[21] Appl. No.: 211,184

[22] PCT Filed: Sep. 21, 1992

[86] PCT No.: PCT/SE92/00652

§ 371 Date: Apr. 5, 1994

§ 102(e) Date: Apr. 5, 1994

[87] PCT Pub. No.: WO93/06280

PCT Pub. Date: Apr. 1, 1993

[30] Foreign Application Priority Data

Sep. 23, 1991 [SE] Sweden ..... 9102751

[51] Int. Cl.[6] ..... D03D 51/34

[52] U.S. Cl. ..... 139/370.2; 250/561; 250/571; 139/192

[58] Field of Search ..... 139/370.2, 192, 139/435.5; 250/561, 571

[56] References Cited

U.S. PATENT DOCUMENTS

| | | | |
|---|---|---|---|
| 4,188,981 | 2/1980 | Suekane et al. | 139/370.2 |
| 4,716,942 | 1/1988 | Jensen et al. | 139/370.2 |
| 4,738,284 | 4/1988 | Ishikawa et al. | 139/370.2 |
| 5,329,961 | 7/1994 | Bouvyn et al. | 139/370.2 |

*Primary Examiner*—Andy Falik
*Attorney, Agent, or Firm*—Antonelli, Terry, Stout & Kraus

[57] ABSTRACT

An apparatus for the arrival monitoring of a weft in a jet loom with a reed pivotal between a first position and a second position. The reed has a longitudinal channel for the weft. An arm is mounted on the reed with the free end of the arm in the proximity of the longitudinal channel. The free end supports a light source and two light-sensitive elements. The light source is directed towards a central part of the channel for illuminating the rear portion of the channel. One light-sensitive element is directed towards the upper corner of the channel, while the other light-sensitive element is directed towards the lower corner of the channel.

17 Claims, 5 Drawing Sheets

REED ASSOCIATED LIGHT SENSITIVE APPARATUS FOR MONITORING WEFT THREAD IN A LOOM

BACKGROUND OF THE INVENTION

The present invention relates to an apparatus for monitoring, preferably arrival monitoring, of the weft, e.g. the weft thread, in a loom of substantially the type in which the weft is driven through the shed with the aid of a jet, preferably a gas jet, e.g. an air jet, and which has a reed which is constructed from a number of lamellae disposed vertically with spacing, and which is pivotal between a first position and a second position and has a longitudinal channel for the weft.

Prior art arrival indicators suffer from an unreliable function which manifests itself primarily in many error signals and in many missed actual error trigger situations. These problems are accentuated particularly in air powered looms, so-called jet looms, which are extraordinarily quick and operate at high speeds such as 20 picks per second, in which event the arrival sensing must be executed during approximately 10–15 per cent of a complete machine cycle (5 per cent of the revolution). This naturally places extreme demands on the indicator itself and the associated electronics, in particular as regards sensitivity and speed. A major inconvenience in prior art arrival indicators is a very high degree of wear, which necessitates replacement of the indicator after short operational lives such as one month.

SUMMARY OF THE INVENTION

The task forming the basis of the present invention is to obviate the drawbacks inherent in prior art arrival indicators to as high a degree as possible.

The present invention realizes an arrival indicator which, with great reliability, may be employed in the most rapid jet looms or air powered looms in that the weft thread is sensed not only during a single instant of time but during a given period of time. This affords: in addition, an effective possibility to distinguish between the passage of some other foreign matter than a weft thread and the presence of the weft thread proper, whereby the risk of confusion is precluded. The apparatus according to the present invention further makes possible monitoring of whether an excessively long weft thread has been blown through the woven fabric and the end has become more or less jumbled at the edge of the fabric. Moreover, the apparatus according to the present invention permits sensing of such threads as have hitherto not been possible to sense in prior art optical indicators, e.g. non-reflective threads. An apparatus according to the present invention will not be subjected to any major degree of wear, whereby the service life of an apparatus according to the present invention has been greatly extended. It is also possible to employ the apparatus according to the present invention for controlling the air emission in the loom, since the indicator or the apparatus according to the present invention sees the entire channel or homogeneously into the entire channel and it thereby becomes possible to establish the exact arrival time of the thread with a very high degree of accuracy.

BRIEF DESCRIPTION OF THE DRAWINGS

Embodiments of the present invention will be described in greater detail hereinbelow, with particular reference to the accompanying Drawings.

DETAILED DESCRIPTION OF PREFERRED EMBODIMENTS

Figure 1:
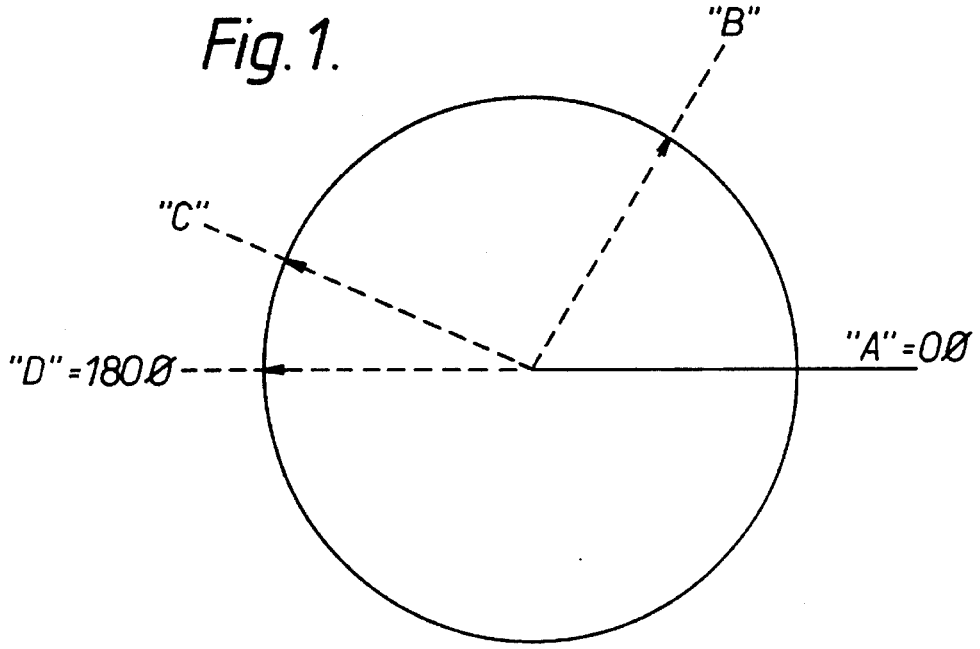
FIG. 1 schematically illustrates a vector diagram of a machine cycle.

Embodiments of an apparatus according to the present invention will be described more closely hereinbelow in connection with a jet loom or air powered loom. Such looms are well known in the art and will not, therefore, be described in-depth here, but only those parts which are directly related to the apparatus according to the present invention will be described in detail. These parts are shown in greater detail in FIG. 2 and consist of a reed which includes a relatively large number of lamellae 1 which are disposed upstanding and with spacing on a beam 2. The upper ends of the lamellae 1 are secured in a U-shaped rail 3 and the lower ends of the lamellae 1 are secured in a U-shaped rail 4. The pack consisting of the lamellae 1 and the rails 3 and 4 is positioned with the U-shaped rail 4 in a groove 5 in the beam 2 and is clamped in the groove 5 with the aid of one or more keys or wedges 6. Warp threads (not shown) extend in the space between the lamellae 1 and together with a plurality of weft threads (not shown) form a woven fabric (not shown).

Figure 2:
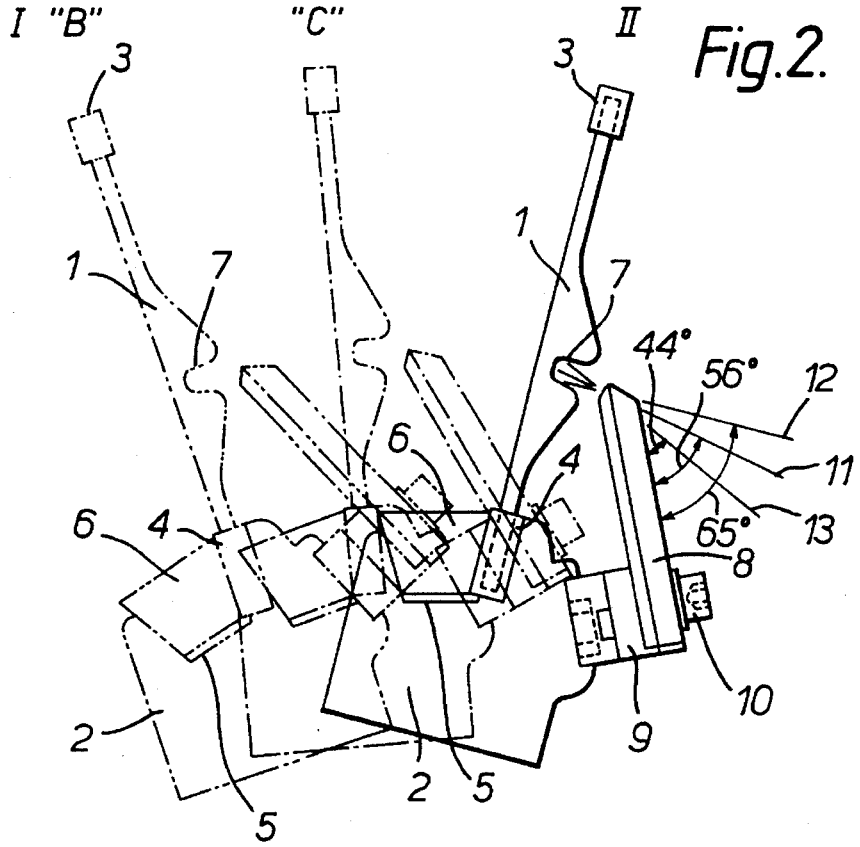
FIG. 2 is a side elevation of a reed with an apparatus according to the present invention in different positions during a machine cycle.

FIGS. 1 and 2 illustrate more closely a machine cycle or a machine revolution and the movements of the parts in question during one such machine cycle or one such machine revolution. From the start of a machine cycle at "A" or 0°, the reed moves as illustrated in FIG. 2 slowly to position I or "B". The degree division of a machine cycle described herein is merely by way of exemplification and other degree divisions can be applied in different types of machines. On inserting the weft thread with the aid of an air jet, it will be located in the channel 7 formed in the lamellae 1 at least at the end of its path of movement or at the fabric edge where it is desirable to establish the presence or arrival of the weft thread, for which reason an apparatus according to the present invention is placed at this point, as is apparent in FIG. 2.

That point in time at which the weft thread occurs in the channel 7 behind the free end of an arm 8 is not predeterminable to 100 per cent but should occur between the positions "B" and "C" in FIGS. 1 and 2. These positions may vary from loom to loom and are dependent upon manufacture and settings, for which reason no determined degree figure therefore is given here. During the period of time from position "B" to "C", the reed is in motion from position I to II (FIG. 2). After position "C", it is considered to be too late for a normal arrival of the weft thread, since the reed in this position has approached too close to the fabric edge. The apparatus according to the present invention is to monitor or check that the weft thread is located in the channel 7 and thereby between the free end of the arm 8 and the rear edge or bottom of the channel 7 in the period of time between positions "B" and "C".

The machine cycle naturally controls the apparatus according to the present invention and is synchronized with some type of sensor, for example an inductive or optical sensor which is coupled to the loom in such a manner that a "flag signal" (logic signal) is established at position "A" and cancelled at position "C". This arrangement is well known in the art and will not be described in greater detail here.

The arm 8 in the illustrated embodiment of an apparatus according to the present invention is mounted on the beam 2 with the aid of mounting fittings 9 and an Allen bolt 10. The mounting fittings 9 and the bolt 10 permit orientation positioning of the arm 8 so that the free end of the arm 8 will be placed in a suitable manner ahead of the longitudinal channel 7 in the reed, as illustrated in FIG. 2. FIG. 2 also intimates with solid lines three optical axes 11, 12 and 13 as well as that angle which each respective optical axis makes with the longitudinal axis of the arm 8 seen from the side or the projection illustrated in FIG. 2. These angles are, moreover, shown in greater detail in FIG. 3.

Figure 3:
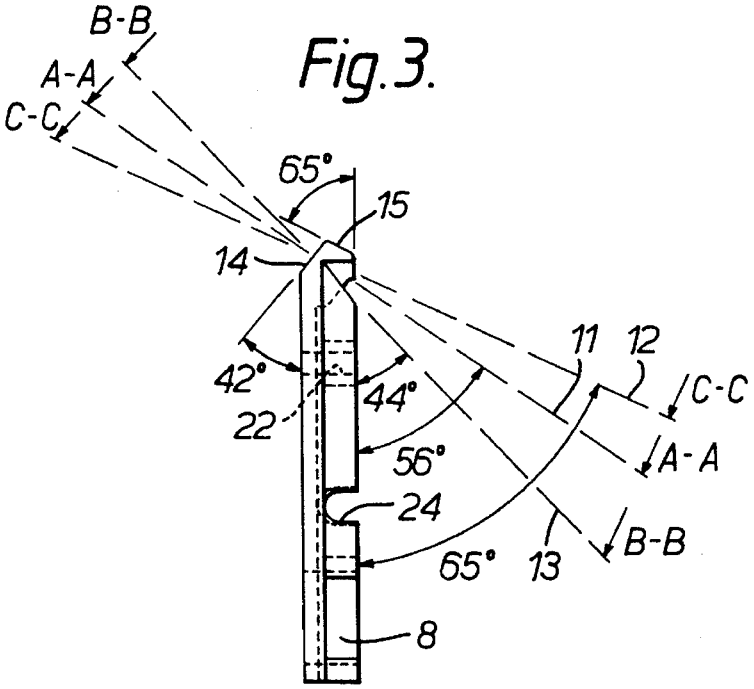
FIG. 3 is a side elevation of a part of an apparatus according to the present invention.

The arm 8 is shown in greater detail in FIGS. 3–8, FIGS. 4, 5 and 6 showing respectively sections A—A, B—B and C—C in FIG. 1 on a larger scale. The above-mentioned optical axes 11, 12 and 13 are shown in the sections. In FIG. 3, it is more clearly apparent that the optical axis 11 makes an angle of 50°–60°, preferably 56°, with the longitudinal axis of the arm 8, while the optical axis 12 makes an angle with the longitudinal axis of the arm 8 of 60°–70°, preferably 65°, and the optical axis 13 makes an angle with the longitudinal axis of the arm 8 of 40°–50°, preferably 44°. The arm 8 displays, at its free end, a planar surface 14 which makes an angle of 40°–45°, preferably 42°, with the longitudinal axis of the arm 8. The free end of the arm 8 is terminated by a further planar surface 15 which makes an angle of 60°–70°, preferably 65°, with the longitudinal axis of the arm 8. The above-mentioned angles can, naturally, vary from design to design, depending upon the appearance and dimensions of the longitudinal channel 7 in the reed, which may vary from machine design to machine design.

Figure 4:
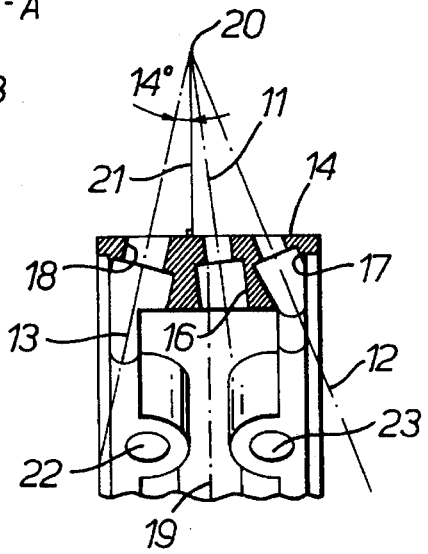
FIG. 4 shows a section taken along the line A—A in FIG. 3.
Figure 5:
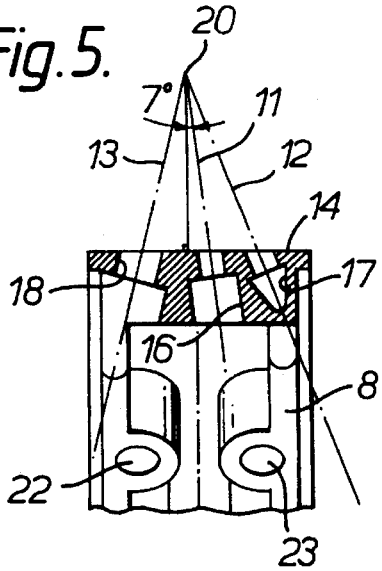
FIG. 5 shows a section taken along the line B—B in FIG. 3.
Figure 6:
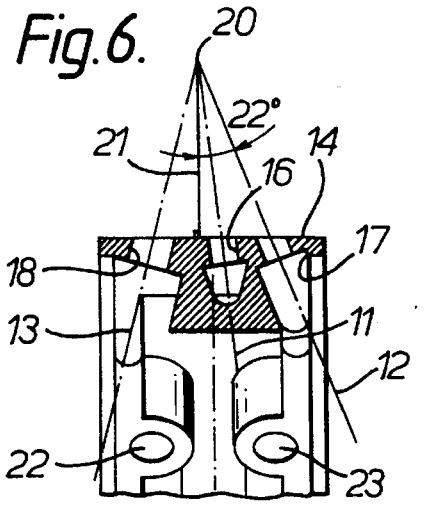
FIG. 6 shows a section taken along the line C—C in FIG. 3.

In the free end of the arm 8, there is provided a recess 16 which discharges in the surface 14 and is intended for a light source in the form of a suitable LED. The recess 16 is oriented such that the optical axis, of the LED placed therein coincides with the optical axis 11 which is shown by ghosted lines. In the free end of the arm 8, there is further provided a recess 17 which discharges in the planar surface 14 and is intended for a light-sensitive element in the form of a suitable phototransistor TR1. The recess 17 is oriented such that the optical axis of the phototransistor TR1 placed therein coincides with the optical axis 12 which is shown by ghosted lines. In the free end of the arm 8, there is further provided a recess 18 which discharges in the planar surface 14 and is intended for yet a further light-sensitive element in the form of a phototransistor TR2 and which is aligned such that the optical axis of the phototransistor TR2 coincides with the intimated optical axis 13 which is shown by ghosted lines. As reference line, the longitudinal axis of the arm 8 is shown in the various Drawing FIGS. 4, 5, 6 and 8 in the form of a ghosted line 19. In FIGS. 4, 5 and 6, it is shown that the optical axes 11, 12 and 13 intersect one another at a point 20 which is also designated the focal point for the light source and the light-sensitive elements.

Through the focal point 20, there extends a normal 21 to the planar surface 14 and, in FIG. 4, it is shown that the optical axis 13 makes an angle with the normal 21 of 12°–16°, preferably 14°. In FIG. 5 it is shown that the optical axis 11 makes an angle of 5°–10°, preferably 7°, with the normal 21, and in FIG. 6 it is apparent that the optical axis 12 makes an angle of 20°–25°, preferably 22°, with the normal 21. The arm 8 is oriented such that the focal point 20 is located approx. 1 mm ahead of the distal edge in the channel 7.

Figure 7:
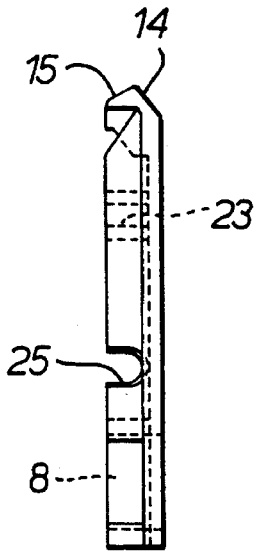
FIG. 7 is a side elevation of the part illustrated in FIG. 3 seen from the opposite side.
Figure 8:
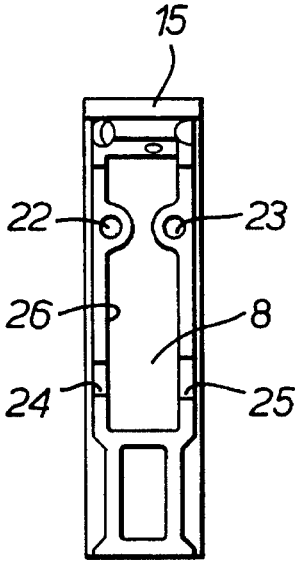
FIG. 8 is a front elevation of the part of an apparatus according to the present invention illustrated in FIG. 3.

FIG. 7 shows the arm 8 from the opposite side relative to FIG. 3, while FIG. 8 shows the arm 8 from the front. In the arm 8, there are further accommodated holes 22 and 23, recesses 24 and 25 and a milling 26 for mounting and placing of, for example, electronic components.

As is particularly apparent from FIG. 2, the light source will, with its optical axis 11, illuminate the rear edge or bottom in the longitudinal channel 7 in the reed. The light source or LED must be of the wide radiating type for relatively uniform illumination of the bottom or the rear edge in the channel 7. It is further apparent from FIG. 2 that the optical axis 12 of the light-sensitive element or phototransistor TR1 is directed towards the lower corner in the longitudinal channel 7 or the lower edge of the bottom in the longitudinal channel 7. The optical axis 13 of the light-sensitive element or phototransistor TR2 is directed towards the upper corner in the longitudinal channel 7 or the upper edge of the bottom in the longitudinal channel 7. The light-sensitive elements or phototransistors TR1 and TR2 should advantageously have narrow sensitivity lobes. The optical axis 11 of the light source or LED impinges as well centrally on the bottom of the longitudinal channel 7 or centrally on the rear edge in the longitudinal channel 7 between the upper corner and the lower corner. Hereby, the entire bottom or rear edge in the longitudinal channel 7 will be illuminated and there will be obtained a reflection from the entire rear edge or bottom in the longitudinal channel 7.

Figure 9:
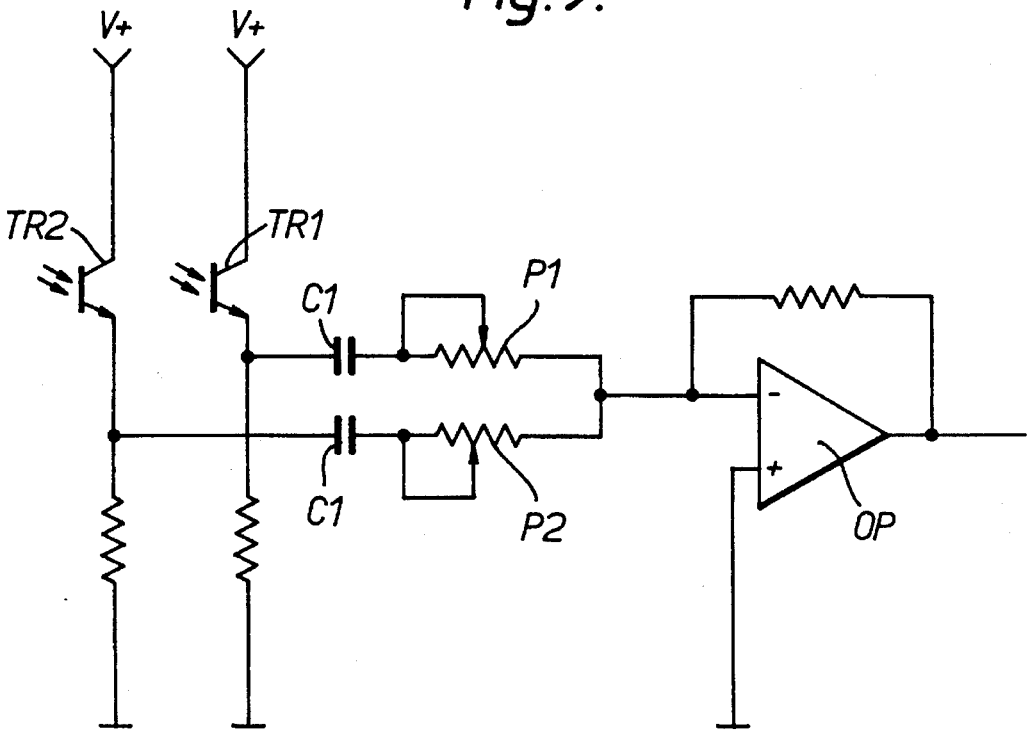
FIG. 9 is a schematic diagram of a part of the electronic circuitry in which an apparatus according to the present invention is included.

The electronic elements in the form of the LED and the phototransistors TR1 and TR2 are coupled into a suitable electronic circuit for driving the light source with a carrier wave signal of a frequency of a few kHz, while the phototransistors are coupled into a circuit of, for example, the type illustrated in FIG. 9 which is a per se known signal charging circuit. The phototransistor TR1 is coupled to the negative input of an operational amplifier OP via a potentiometer P1 and a capacitor C1, and the phototransistor TR2 is coupled to the negative input of the operational amplifier OP via a potentiometer P2 and a capacitor C2. The potentiometers P1 and P2 serve for suitable adjustment of the amplitude of the signal obtained on the output from the operational amplifier OP. The amplitude of the signal will reflect changes in the light reflection on the two phototransistors TR1 and TR2 because of the presence of a thread or a weft in the channel 7, whereafter the amplitude change in the signal can be evaluated with the aid of a suitable electronic circuit which is included in a central unit for the loom. If the signal from the operational amplifier OP does not satisfy the criteria set by the electronic circuitry, an error function will be triggered, and this can entail knock-off or arrest of the loom.

In that case where it is desirable to operate at higher frequencies than a few kHz, it may be appropriate to replace the phototransistors by photodiodes which are more rapid than the phototransistors. In certain cases, it may be appropriate to replace the two potentiometers by a single potentiometer which is coupled in between the phototransistors and whose slider is connected to earth.

The embodiment of the present invention illustrated in FIGS. 10–13 corresponds in principle to the above-described embodiment and differs substantially from the above-described embodiment in that the recesses 17' and 18' for the phototransistors TR1 and TR2 are located substantially straight above one another, and in that the optical axes 11', 12' and 13' make other angles with the longitudinal axis 19' of the arm 8' than in the above-described embodiment.

Figure 12:
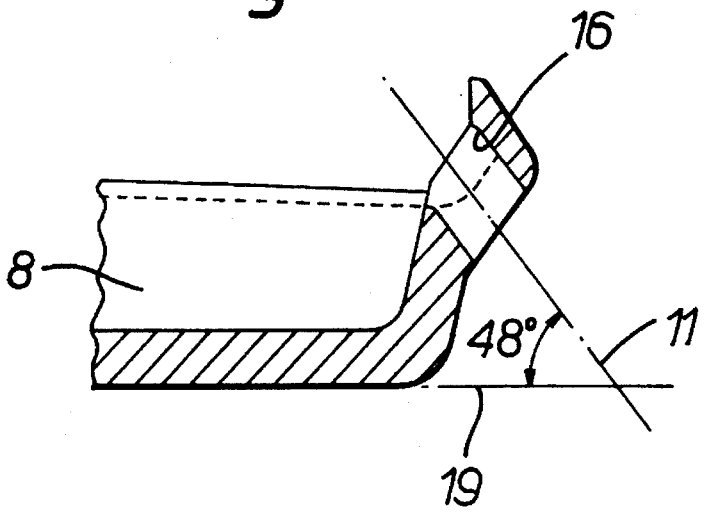
FIG. 12 shows a section taken along the line XII—XII in FIG. 11.
Figure 13:
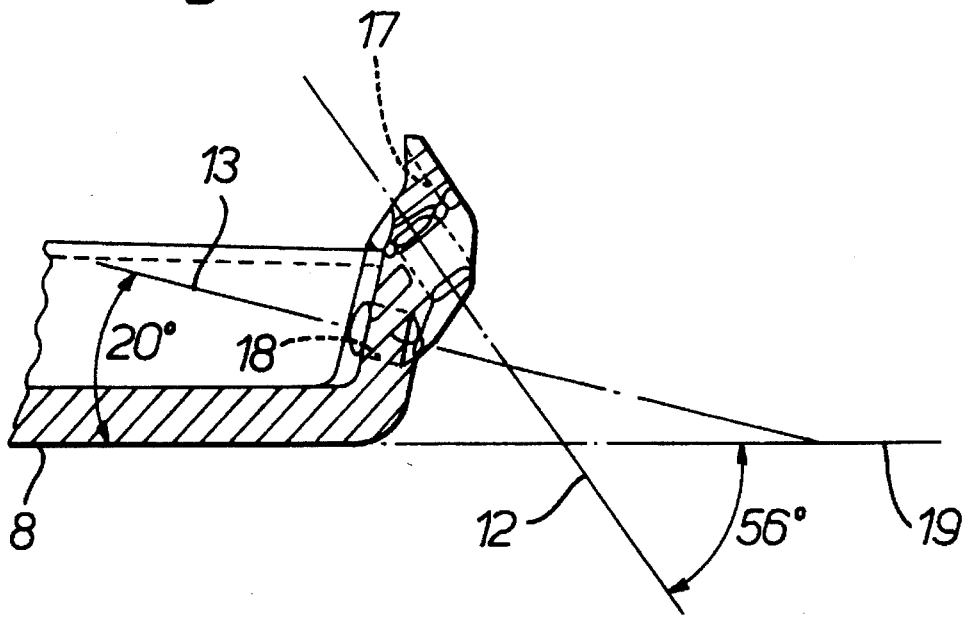
FIG. 13 shows a section taken along the line XIII—XIII in FIG. 11.

In this new embodiment, the optical axis 11' for the recess 16' makes an angle of 45°–55°, preferably 48°, with the longitudinal axis 19 of the arm 8', which is located in the surface of the arm 8' facing towards the reed, as is apparent in FIG. 12. The recess 16' is intended for an LED, as in the above-described embodiment. Seen in the projection shown in FIG. 11, the optical axes 11', 12' and 13' make an angle of 10°–15°, preferably 13°, with the longitudinal axis 19 of the arm 8'. The point of intersection between the axes 11', 12' and 13' forms the focal point 20'.

Figure 10:
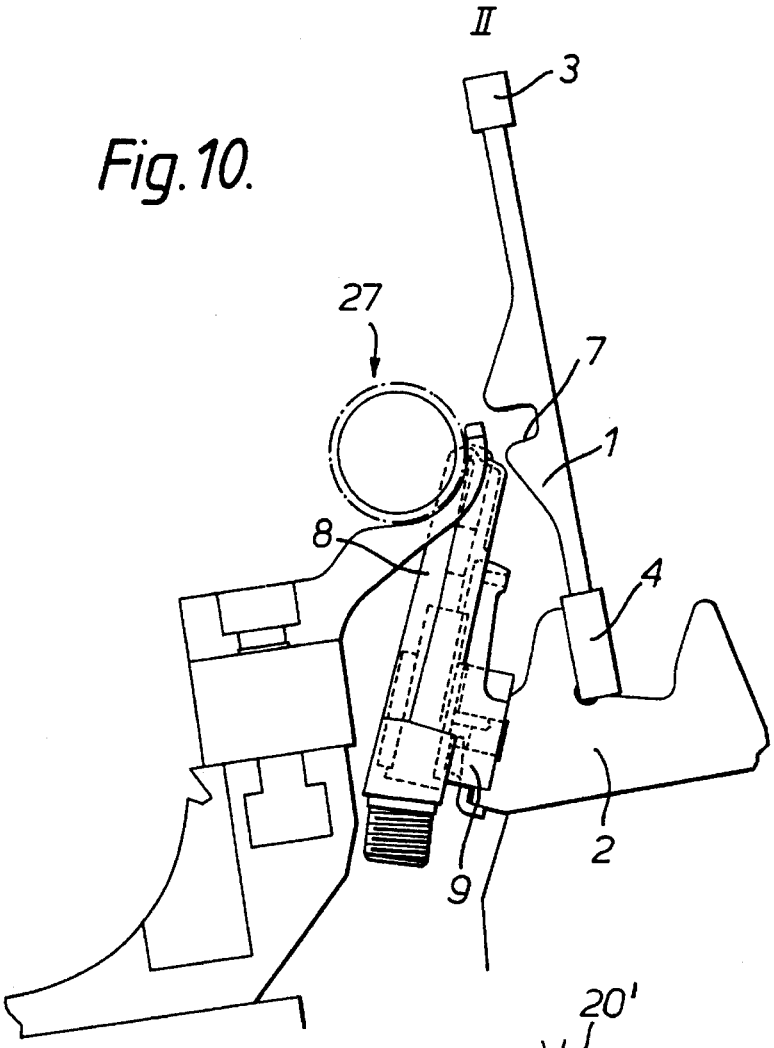
FIG. 10 is a side elevation of a reed with an apparatus according to another embodiment of the present invention.
Figure 11:
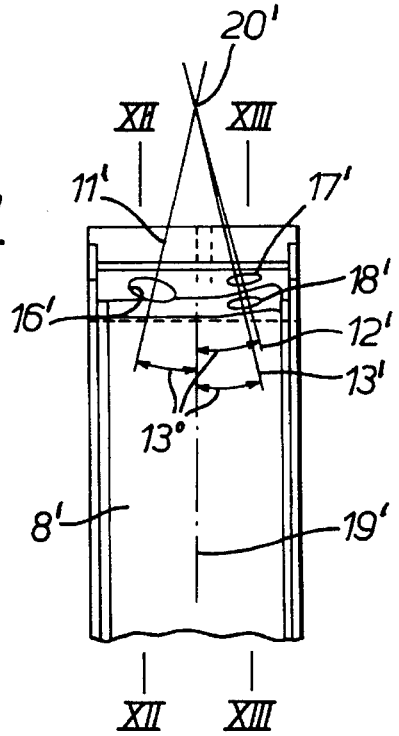
FIG. 11 is a view from the left in FIG. 10 of a part of the apparatus according to the present invention.

FIG. 10 shows, in addition to the parts illustrated in FIG. 2, also a temple 27 which does not constitute any part of the invention proper according to this disclosure.

The major advantage of the present invention is that the phototransistors TR1 and TR2 are located in substantially the same plane, whereby scanning of the channel 7 will be considerably more exact. Furthermore, the arm 8' can be given a somewhat more slender and above all more compact design and construction.

I claim:

1. An apparatus for monitoring of the weft in a loom of the type in which the weft is driven through the shed of the loom with the aid of a jet and which has a reed pivotally disposed for pivoting between a first position and a second position, the reed having a longitudinal channel for the weft, said apparatus comprising an arm having a free end adapted to be located in the proximity of the longitudinal channel in the reed; and means at the arm free end for holding a light source and two light-sensitive elements, with the light source directed towards the channel for illuminating a rear portion of the channel, and with one light-sensitive element directed towards an upper corner of the channel, and the other light-sensitive element directed towards a lower corner of the channel.

2. The apparatus as claimed in claim 1, further comprising a light source and two light-sensitive elements held by said holding means, wherein the light source is wide radiating for illuminating substantially an entire rear edge or the bottom in the longitudinal channel in the reed, so that the entire rear of the channel or bottom is included as a reflector, and wherein the light-sensitive elements have narrow sensitivity lobes.

3. The apparatus as claimed in claim 1, wherein the arm is adapted to be mounted on a lower portion of the reed so as to extend up towards the longitudinal channel in the reed.

4. The apparatus as claimed in claim 1, wherein said holding means comprises a first recess in the free end of the arm for holding the light source, and second and third recesses in the free end of the arm for holding the light-sensitive elements.

5. The apparatus as claimed in claim 4, further comprising a light source and two light-sensitive elements held by said holding means, wherein the light source is an LED of the wide radiating type and the light-sensitive elements are phototransistors with narrow sensitivity lobes.

6. The apparatus as claimed in claim 5, further comprising a signal charging circuit including an operational amplifier for having the light-sensitive elements incorporated therein to generate an amplitude-varying signal via the operational amplifier.

7. The apparatus as claimed in claim 4, wherein the recesses are adapted to hold the light source and the light-sensitive elements with optical axes of the light source and the light-sensitive elements oriented in discrete directions.

8. The apparatus as claimed in claim 7, wherein the first recess is adapted to hold the light source with an optical axis of the light source making an angle of substantially 13° with the longitudinal axis of the arm as seen from the front of the arm, and the second and third recesses area adapted to hold the two light-sensitive elements with optical axes of the two light-sensitive elements making an angle of substantially 13° with the longitudinal axis of the arm as seen from the front of the arm.

9. The apparatus as claimed in claim 8 wherein the arm is adapted to be mounted in a lower portion of the reed so as to extend up towards the longitudinal channel in the reed such that focal points of the light source and the two light-sensitive elements lie a distance from the rear edge or bottom in the longitudinal channel in the reed.

10. The apparatus as claimed in one of claims 4 and 7, wherein the first recess is adapted to hold the light source with an optical axis of the light source making an angle of substantially 48° with the longitudinal axis of the arm as seen from one side of the arm, the second recess is adapted to hold one light-sensitive element with an optical axis of said one light-sensitive element making an angle of substantially 56° with the longitudinal axis of the arm as seen from said one side, and the third recess is adapted to hold the other light-sensitive element with an optical axis of said other light-sensitive element making an angle of substantially 20° with the longitudinal axis of the arm as seen from said one side.

11. The apparatus as claimed in claim 10, wherein the first recess is adapted to hold the light source with an optical axis of the light source making an angle of substantially 13° with the longitudinal axis of the arm as seen from the front of the arm, and the second and third recesses are adapted to hold the two light-sensitive elements with optical axes of the two light-sensitive elements making an angle of substantially 13° with the longitudinal axis of the arm as seen from the front of the arm.

12. The apparatus as claimed in claim 11 wherein the arm is adapted to be mounted in a lower portion of the reed so as to extend up towards the longitudinal channel in the reed such that focal points of the light source and the two light-sensitive elements lie a distance from the rear edge or bottom in the longitudinal channel in the reed.

13. The apparatus as claimed in claim 4, wherein the first recess is adapted to hold the light source with an optical axis of the light source making an angle of substantially 13° with the longitudinal axis of the arm as seen from the front of the arm, and the second and third recesses are adapted to hold the two light-sensitive elements with the optical axes of the two light-sensitive elements making an angle of substantially 13° with the longitudinal axis of the arm as seen from the front of the arm.

14. The apparatus as claimed in claim 13 wherein the arm is adapted to be mounted in a lower portion of the reed so as to extend up towards the longitudinal channel in the reed such that focal points of the light source and the two light-sensitive elements lie a distance from the rear edge or bottom in the longitudinal channel in the reed.

15. The apparatus as claimed in claim 1, further comprising a signal charging circuit including an operational amplifier for having the light-sensitive elements incorporated therein to generate an amplitude-varying signal via the operational amplifier.

16. The apparatus as claimed in claim 15, further comprising a light source and two light-sensitive elements held by said holding means, wherein the light source is an LED of the wide radiating type and the light-sensitive elements are phototransistors with narrow sensitivity lobes.

17. The apparatus as claimed in claim 1, further comprising a light source and two light-sensitive elements held by said holding means, wherein the light source is an LED of the wide radiating type and the light-sensitive elements are phototransistors with narrow sensitivity lobes.

* * * * *